US011840851B2

(12) United States Patent
White et al.

(10) Patent No.: US 11,840,851 B2
(45) Date of Patent: Dec. 12, 2023

(54) SUPPORT SYSTEM

(71) Applicant: RYNO LTD., Cranleigh (GB)

(72) Inventors: Anton White, Ellon (GB); Caleb White, Ellon (GB)

(73) Assignee: RYNO LTD., Cranleigh (GB)

( * ) Notice: Subject to any disclaimer, the term of this patent is extended or adjusted under 35 U.S.C. 154(b) by 35 days.

(21) Appl. No.: 17/430,316

(22) PCT Filed: Feb. 10, 2020

(86) PCT No.: PCT/EP2020/053350

§ 371 (c)(1),
(2) Date: Aug. 11, 2021

(87) PCT Pub. No.: WO2020/165103

PCT Pub. Date: Aug. 20, 2020

(65) Prior Publication Data

US 2022/0127864 A1 Apr. 28, 2022

(30) Foreign Application Priority Data

Feb. 11, 2019 (GB) ..... 1901875

(51) Int. Cl.

| | |
|---|---|
| ***E04F 21/00*** | (2006.01) |
| ***E01C 5/00*** | (2006.01) |
| ***E04F 15/02*** | (2006.01) |
| ***E04F 15/024*** | (2006.01) |

(52) U.S. Cl.

CPC ..... *E04F 21/0092* (2013.01); *E01C 5/001* (2013.01); *E01C 5/006* (2013.01); *E04F 15/02183* (2013.01); *E04F 15/02452* (2013.01)

(58) Field of Classification Search

CPC ..... E04F 21/0092; E04F 15/02183; E04F 2015/02094; E04F 2015/02105; E04F 15/02044; E04F 15/02452; E01C 5/001; E01C 5/006

See application file for complete search history.

(56) References Cited

U.S. PATENT DOCUMENTS

2014/0096469 A1* 4/2014 Fountain ..... E04B 1/1903 52/655.1
2015/0113903 A1* 4/2015 McManus ..... E04F 15/02044 52/745.13

(Continued)

FOREIGN PATENT DOCUMENTS

DE 202007002282 U1 6/2008
DE 202013010315 U1 * 2/2014 ..... E04F 15/02044
DE 102015010894 A1 2/2017

(Continued)

OTHER PUBLICATIONS

WIPO, International Search Report for PCT/EP2020/053350, dated Jul. 22, 2020.

*Primary Examiner* — Theodore V Adamos
(74) *Attorney, Agent, or Firm* — HODGSON RUSS LLP

(57) ABSTRACT

A spacer for support elements of a decking or paving support system, has a central region, at least two spacer arms extending laterally from the central region, and a retention portion coupled to the central region, wherein the retention portion has a longest lateral axis extending laterally and wherein the longest lateral axis lies at an angle to each of the at least two spacer arms.

20 Claims, 7 Drawing Sheets

(56) References Cited

U.S. PATENT DOCUMENTS

| | | | | |
|---|---|---|---|---|
| 2017/0037631 | A1* | 2/2017 | McManus | E04F 15/082 |
| 2017/0044776 | A1* | 2/2017 | Rodriguez Lopez | E04F 15/02405 |

FOREIGN PATENT DOCUMENTS

| | | | | |
|---|---|---|---|---|
| IT | MI20110673 | A1 | 10/2012 | |
| WO | WO-2006012804 | A1 * | 2/2006 | E04F 15/04 |
| WO | WO-2015159136 | A1 * | 10/2015 | E04F 13/0826 |
| WO | 2016083497 | A1 | 6/2016 | |

* cited by examiner

SUPPORT SYSTEM

TECHNICAL FIELD

This invention relates to a support system for decking, paving, or other, primarily exterior, flooring. More particularly, the invention relates to a spacer for positioning between support tiles and/or flooring tiles, slabs, panels or similar used in an exterior flooring system.

BACKGROUND OF THE INVENTION

Exterior ground surfaces, such as decking or paving, are popular in a variety of different settings. In general, a plurality of support joists, which may be arranged in a lattice, are secured to pedestals or cradles which directly contact the ground surface. Advantageously, such exterior ground surfaces can be constructed on top of surfaces of uneven height or gradient to create a new, even ground surface using 'self-levelling' or manually adjustable pedestals to support a substructure of a joist lattice. Flooring, such as timber slats, can be directly placed on top of the joists, or support grates or tiles can be placed on top of the joists and a floor surface, for example artificial grass, can be laid on top of the support grates or tiles.

Spacer components ('spacers') to separate grates, tiles, slats, slabs, panels and other flooring elements (either as top-surface components (decking panels, paving slabs, etc) or intermediate support components (grates, tiles, etc.)) are known. Spacers prevent direct contact between flooring elements and/or support elements to prevent wearing and to ensure a precise fit. The flooring and support elements that are generally used in such support systems are rectangular in longitudinal cross section and therefore have 90 degree angle corners and straight sides. Existing spacers generally slot in between flooring elements and have four arms (i.e. have a cross-shaped cross section). The arms are attached to a base, or central portion, by a frangible region. Each arm can be snapped off, as necessary, to accommodate the meeting of four corners of flooring elements, two corners or one corner (at the edge of a flooring space). The ability to snap off one or more arms of the spacer means that only a single spacer model requires manufacture, greatly reducing manufacturing costs. However, the spacer arms must be connected to the main spacer body in such a way that it is possible to easily snap them off, which compromises the strength and rigidity of the spacer, resulting in the possibility of the spacer arms breaking off whilst in position between flooring components, and therefore allowing flooring components to wear against each other. This may have the compound effect of undesirable mis-alignment across a section of flooring.

Additionally, the support substructure of known systems (i.e. the arrangement of joists above the pedestals) can be compromised as a result of uneven loading.

The present invention aims to mitigate the aforementioned problems.

SUMMARY OF THE INVENTION

According to a first aspect of the invention, there is provided a spacer for support elements of a decking or paving support system, comprising a central region; at least two spacer arms extending laterally from the central region; and a retention portion coupled to the central region, wherein the retention portion has a longest lateral axis extending laterally and wherein the longest lateral axis lies at an angle to each of the at least two spacer arms. In use, the retention portion is positioned in a recess of a support joist and is rotatable to align the spacer arms with the edges of flooring elements of the support system.

The retention portion has a shortest axis extending laterally and the length of the shortest axis is configured to be less than the width of an opening of a longitudinal recess of a support joist of the paving or decking support system. This allows the spacer to be inserted into a recess of an upper support joist. Preferably, the longest axis of the retention portion lies between 1 and 45 degrees to at least one of the at least two spacer arms. In this way, the longest axis is typically aligned with the longitudinal recess of a support joist when inserted into the recess, and therefore neither of the spacer arms are aligned with the longitudinal recess. The spacer is rotatable within the longitudinal recess, however, so that at least one of the spacer arms is aligned with the longitudinal recess (and therefore the longest lateral axis will then not be aligned with the longitudinal recess).

The longitudinal recess in a support joist of the paving or decking support system has an overhang on either side of the opening. The longest axis of the retention portion is configured to be longer that the width of the opening of a longitudinal recess, such that the longest axis of the retention portion, after rotation, extends beyond (and underneath) the overhang (on both sides) of the longitudinal recess of the support joist, thereby preventing the spacer from being lifted out from the longitudinal recess. The retention portion preferably abuts a wall of the longitudinal recess of the support joist after rotation in a first direction. Preferably, the extent of rotation in a first direction required to abut the retention portion to the wall is the same as required to align at least one of the spacer arms in the same direction as the length of the support joist/the longitudinal recess of the support joist. This prevents further rotation (in the first direction) and advantageously acts as an indication to a person installing the spacer that it is correctly positioned (i.e. the spacer arms are aligned with the longitudinal recess).

The spacer may comprise four spacer arms separated by 90 degrees, or three spacer arms, wherein first and second arms are separated by 180 degrees and first and third spacer arms are separated by 90 degrees, i.e. in a "T" formation. Alternatively, the spacer comprises two spacer arms separated by 90 degrees, i.e. in an "L" formation.

The retention portion may be any shape, in lateral cross section, whose longest axis exceeds the width of an opening, defined by an overhang of a longitudinal recess of a support joist, and whose shortest axis is less that the width of the overhang. The retention portion is preferably a parallelogram, rectangle, square, hexagon, octagon, oblong or oval.

The spacer preferably further comprises a protrusion extending axially from the retention portion, wherein the protrusion has a width that is less than the shortest lateral axis of the longitudinal portion. This protrusion helps to anchor the spacer within the recess. The protrusion is circular in lateral cross section to facilitate ease of rotation of the spacer within the recess—in other words the protrusion acts as a shaft for supporting the spacer during rotation. The diameter of the protrusion is preferably less than the width of a lower recess portion in a longitudinal recess of a support joist such that the protrusion is configured to be positioned in the lower recess portion.

According to a second aspect of the invention, there is provided an exterior flooring support spacer system comprising at least one support joist having a longitudinal recess, wherein the longitudinal recess has an opening, wherein the opening is defined by an overhang of the longitudinal recess, a spacer for spacing flooring elements, wherein the spacer comprises a central region, at least two spacer arms extending radially from the central region and a retention portion coupled to the central region, wherein the spacer is insertable in the longitudinal recess of the support joist in an insertion position and is rotatable in a first direction from the insertion position by an angle between 1 and 45 degrees to move the retention position to a retaining position, wherein the retention portion extends beyond the width of the opening of the longitudinal recess in the retaining position to prevent removal of the spacer from the longitudinal recess. retention.

Preferably, the retention portion has a shortest lateral axis which is shorter than the width of the opening of the longitudinal recess of the exterior flooring support joist, and the retention portion has a longest lateral axis which is offset from each of the at least two spacer arms.

The length of the longest lateral axis of the retention portion is preferably configured to be greater than the width of the opening of the longitudinal recess of the support joist.

Optionally, the retention portion is configured to abut a wall of the longitudinal recess of the support joist in the retaining position to prevent further rotation of the spacer in the first direction.

According to a third aspect of the invention, there is provided a substructure for a paving or decking support system, comprising at least two upper joists extending in a first direction; at least two lower joists extending in a second direction; wherein the at least two lower joists are positioned below the at least two upper joists.

Preferably, the second direction is perpendicular to the first direction. However, the joists may be arranged to form obtuse and acute angles at the intersection of the joists. Preferably, each of the at least to upper support joists comprise a longitudinal recess having an overhang, wherein the longitudinal recess is configured to receive a spacer as described.

Preferably, each of the at least two upper support joists comprise at least one flange extending laterally from a bottom surface of the joists and along the length of the at least two upper support joists, wherein the upper surface of the at least one flange comprises a depression which extends along the length of the flange, and preferably each of the at least two lower support joists comprise a depression on an upper surface of each of the at least two lower support joists, wherein the depression extends along the length of each of the at least two lower support joists. The depression and flanges allow the support joists to be securely fixed together, such that, preferably, the at least two upper support joists are secured to the at least two lower support joists by screws which extend between the depression on the flange of the at least two upper support joists and the depression on the upper surface of the at least two lower support joists. The width of the depression on the upper surface of the at least two lower support joists may be the same or less than the width of the screw thread. Preferably, the depression on the upper surface of the at least two lower support joists is flexed upwards towards the upper support joist under tension of the screw. This creates a biasing force which further secures the position of the screw, placing the screw in tension.

According to a fourth aspect of the invention, there is provided a spacer for support elements of a decking or paving support system, comprising a central region; at least two spacer arms extending radially from the central region; and a retention portion coupled to the central region, wherein the retention portion has a longest lateral axis extending laterally with respect to the direction in which the central portion extends and which is longer than the width of an opening of a longitudinal recess of an exterior flooring support joist, and wherein the longest lateral axis lies at a non-zero angle to each of the at least two spacer arms.

According to a fifth aspect of the invention, there is provided a substructure for an exterior flooring support system, comprising at least one upper support joist having at least one flange extending along the length of the support joist and from a bottom surface of the upper support joist; at least one lower support joist, wherein the at least one lower support joist has an upper surface; wherein the at least one lower support joist is fixable to the at least one upper support joist by means of at least one screw extending between the at least one flange of the upper support joist and the upper surface of the at least one lower support joist.

Preferably, the flange of the upper support joist and/or the upper surface of the at least one lower support joist is formed such that, when the upper support joist is laid on top of, and cross-wise, to the lower support joist, there is a gap between the flange of the upper support joist and the upper surface of the at least one lower support joist, wherein the height of the gap is defined by the upper surface of the at least one lower support joist and the at least one flange of the at least one upper support joist. The upper surface of the at least one lower support joist may comprise a depression extending along the length of the at least one upper support joist. The at least one upper support joist and the at least one lower support joist are preferably fixable together by at least one screw, wherein tightening of at least one screw reduces the height of the gap.

BRIEF DESCRIPTION OF THE DRAWINGS

The invention is described with reference to the following drawings in which.

DETAILED DESCRIPTION

Figure 1A:
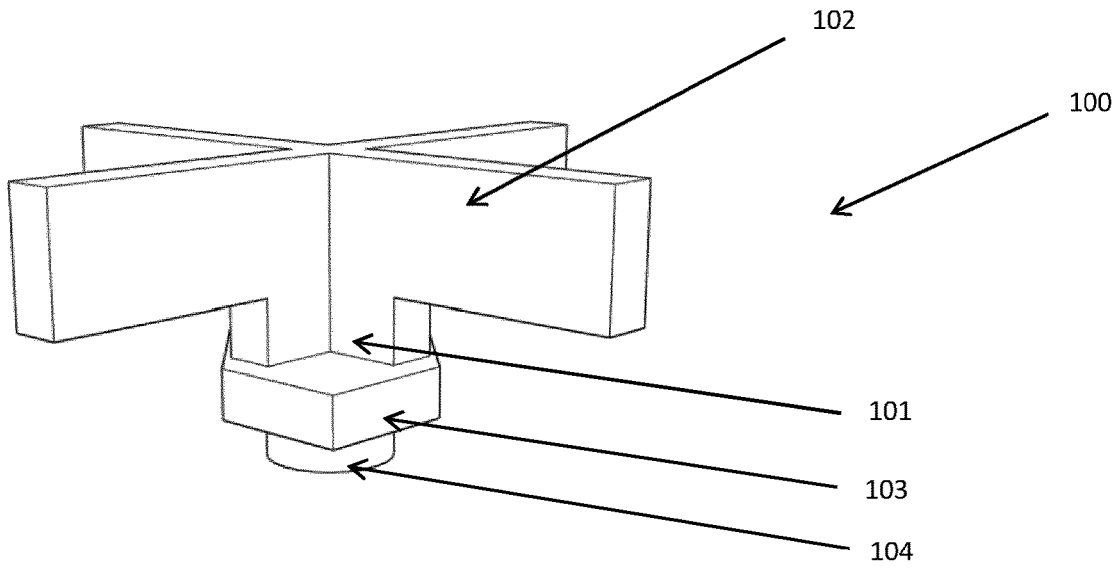
FIG. 1*a* is a perspective view of a spacer according to an embodiment of the invention.

FIG. 1*a* is a perspective view of a spacer according to a first embodiment of the invention. Spacer 100 comprises a central portion 101 from which four spacer arms 102 extend laterally. 'Laterally' or 'lateral' in this context is used to mean a direction which is perpendicular to the direction in which the central region extends (i.e. between its two distal ends). In FIG. 1*a*, the central region extends vertically and the spacer arms extend horizontally from the central region. Put another way, the spacer arms extend radially from the central portion. As shown in FIG. 1*a*, the spacer arms are evenly positioned about a central vertical axis such that the spacer arms are separated by 90 degrees, in order to separate four 90 degree corners of different flooring elements. It will be appreciated, however, that the spacer arms may be unevenly positioned about the central vertical axis to accommodate flooring elements having obtuse and acute corners. Moreover, and as described in further detail below, further embodiments of the invention have two and three spacer arms to facilitate the separation of other configurations of flooring elements.

Figure 1B:
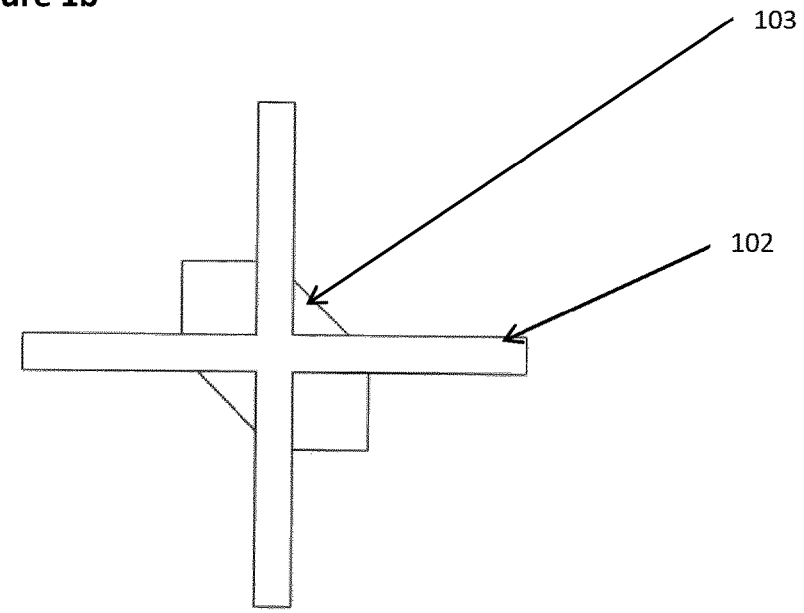
FIG. 1*b* is a plan view of the spacer of FIG. 1.

A retention portion 103 extends downwardly from one end of the central region 101. As can be seen from FIGS. 1*a* and 1*b*, retention portion 103 has the shape, in lateral cross section, of a hexagon, extended along one axis of symmetry. Retention portion 103 therefore has a longest lateral axis which extends in the same plane as the spacer arms 102 extend from the central portion 101. The lateral cross sectional shape of retention portion 103 may be any shape which has a longest or lateral axis (such as, for example, the major axis of an ellipse, the diagonal of a square or the diagonal or line intersecting the two shortest sides of a rectangle), such as square, isosceles or scalene triangle, oval/ellipse, oblong, rectangle, parallelogram or octagon. As shown in FIG. 1*b*, the longest lateral axis of retention portion 103 is offset from the spacer arms 102 by 45 degrees. However, the longest lateral axis of retention portion 103 may be offset from a spacer arm by any non-zero angle sufficient to 'lock' the spacer 100 and prevent vertical movement of the spacer 100, as described below. The longest axis is not aligned with a spacer arm 102.

Figure 1C:
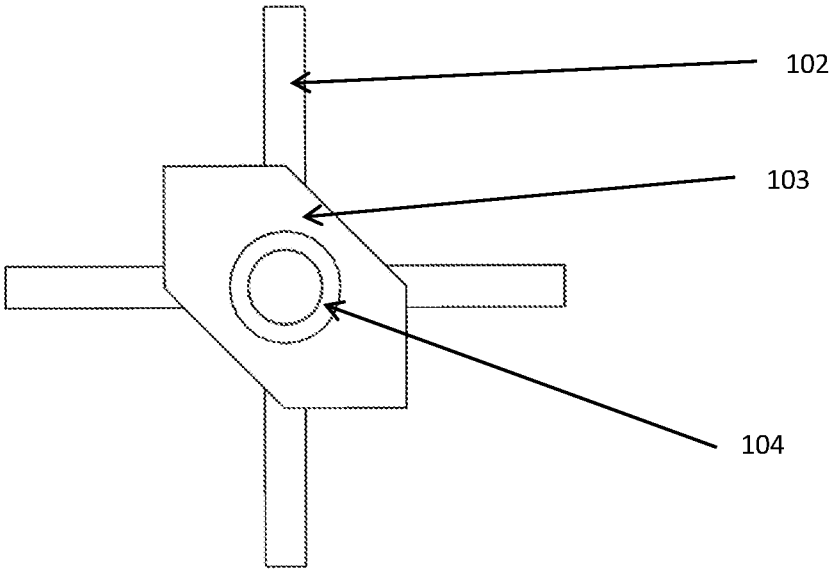
FIG. 1*c* is an underside perspective view of the spacer of FIG. 1.
Figure 1D:
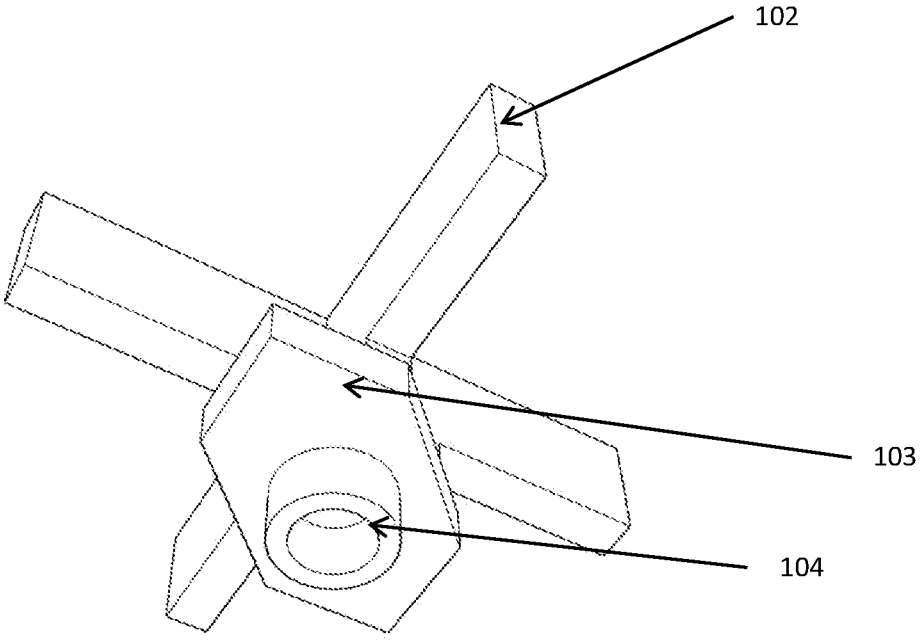
FIG. 1*d* is an underside plan view of the spacer of FIG. 1.

FIGS. 1*c* and 1*d* are an underside perspective view and plan view respectively of spacer 100. Protrusion 104 extends downwardly from the retention portion 103 and is annular in cross section, although it may be circular in cross section. The circumference of protrusion 104 allows spacer 100 to be rotated in a lateral plane when positioned in a recess of a support joist, as seen in FIGS. 3*a* and 3*b*.

Figure 2:
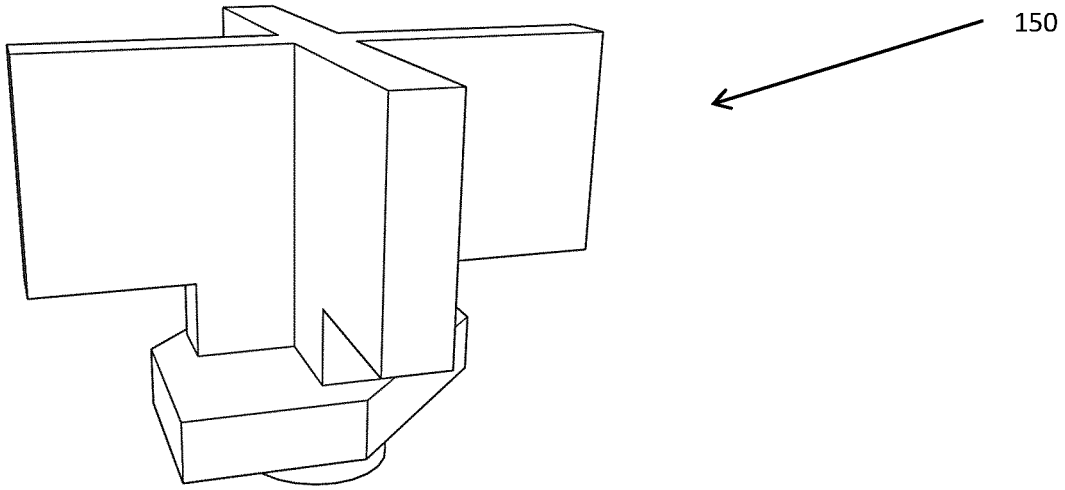
FIG. 2 is a perspective view of a spacer according to an embodiment of the invention.

FIG. 2 is an embodiment of a spacer 150 in which the spacer arms are shorter in length (in the direction in which they extend from the central region) than the spacer arms 102 of spacer 100.

Figure 3A:
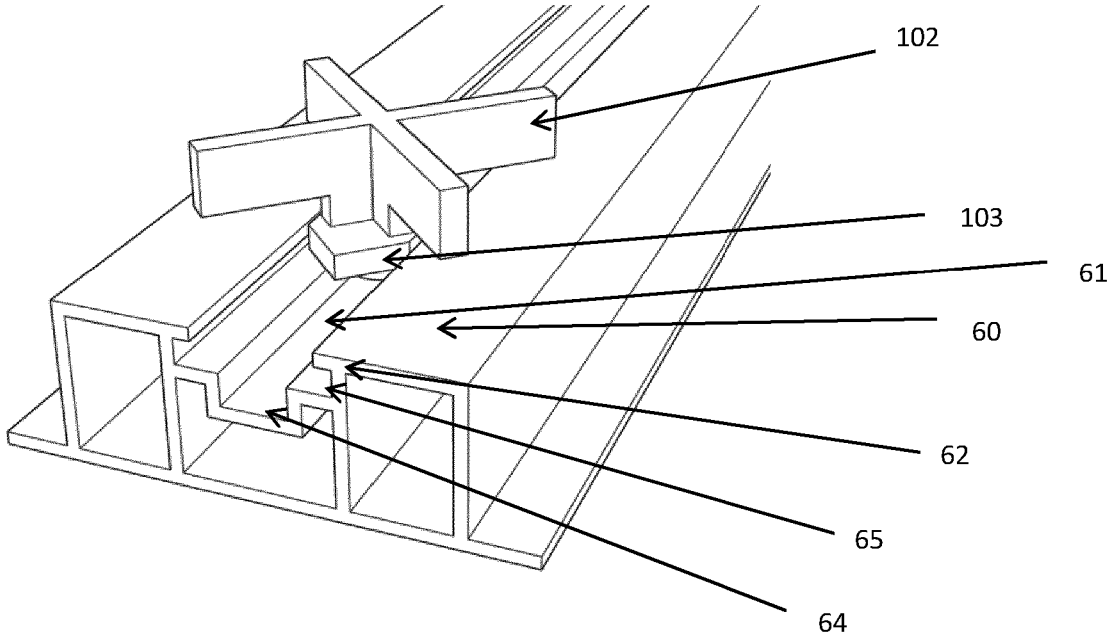
FIG. 3*a* is a perspective view of the spacer of FIG. 1 resting within a recess of an upper support joist.
Figure 3B:
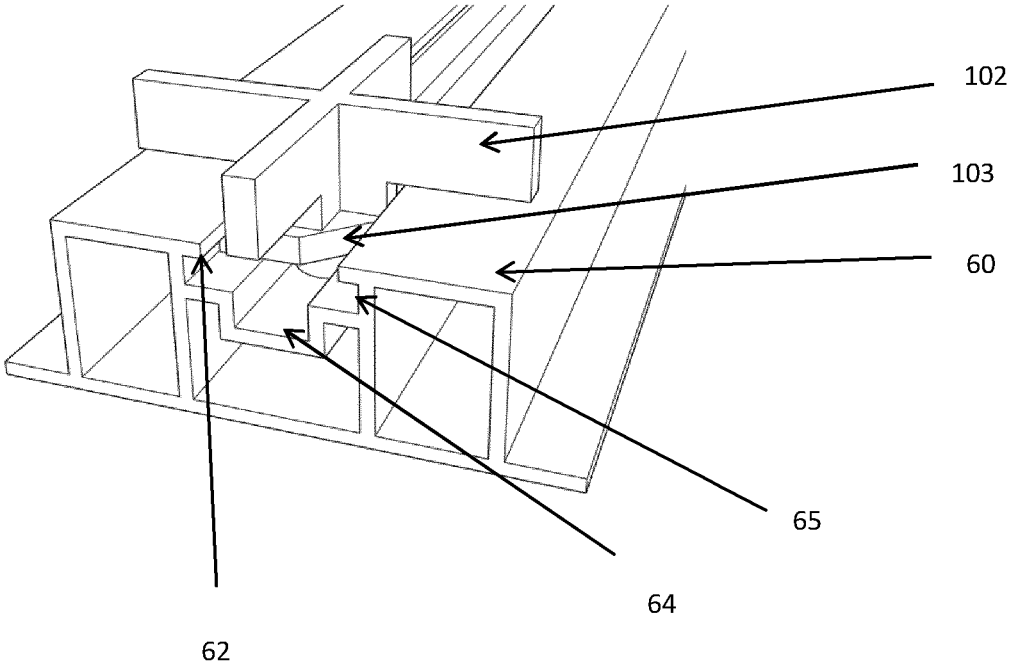
FIG. 3*b* is a perspective view of the spacer of FIG. 1 rotated by 45 degrees in the locked position within a recess of an upper support joist.

FIG. 3*a* is a perspective view of spacer 100 and upper support joist 60. Upper support joist 60 has recess 61 which runs longitudinally along the top side of upper support joist 60. Overhang 62 reduces the width of recess 61 at its opening. Recess 61 has a 'stepped' cross section, in that a lower portion 64 of recess 61 has a smaller width than upper portion 65 of recess 61. As shown in FIG. 3*a*, the longest axis of retention portion 103 of spacer 100 is aligned with the longitudinal axis of recess 61, and spacer arms 102 are at 45 degrees to the longitudinal axis of recess 61. Protrusion 104 sits within the lower portion 64 of recess 61 and the retention portion 103 sits within the upper portion 65 of recess 61 but, in the unlocked position shown in FIG. 3*a*, does not extend underneath overhang 62. Spacer 100 is therefore in the open or unlocked position.

It will be understood that an axis of retention portion 103 must be less than the width of the opening defined by overhang 62 in order to fit through the opening and also that the longest or major axis of retention portion 103 must be longer that the width of the opening to prevent vertical movement of the spacer after rotation of the spacer in a first direction. Given that the point of rotation of retention portion 103 is mid-way along the width of the opening (i.e. it is centrally located within the width of the opening), the length of the longest axis of retention portion 103 must, as retention portion 103 rotates, be longer than the width of the opening—i.e. the lengths of the longest axis on either side of the pivot point are greater than half the width of the opening. The side of an equilateral triangle, for example, is a longest axis which must be less than the width of the opening (to be insertable in recess), but therefore cannot extend, on both sides, beyond overhang 62 when rotated. From an insertion position, the spacer may, however, be rotated in a first direction by any angle sufficient to move retention portion 103 in a retained position such that either end of the retention portion (i.e. the ends of the longest lateral axis) lies underneath overhang 62. Preferably, the spacer may be rotated in a first direction until one or both ends of the retention portion abut a wall of the longitudinal recess, thereby preventing further rotation in the first direction.

When intermediate support elements such as support grates, tiles or timber panels or top-surface support elements such as paving slabs or decking panels are to be fitted onto a substructure comprising support joists 60, spacer 100 is rotated in a first direction by 45 degrees such that two spacer arms 102 lie parallel and aligned with longitudinal axis of recess 61 and two spacer arms 102 lie perpendicular to longitudinal axis of recess 61. Rotation of retention portion 103 by +/−45 degrees from an insertion position (i.e. the position at which the spacer 100 is inserted into the longitudinal recess 61) means that the longest axis of retention portion 103, having previously be aligned with the longitudinal axis of recess 61, will be at 45 degrees to the longitudinal axis of recess 61 and will partly extend under overhang 62, thereby retaining the spacer (such that it cannot be moved vertically and lifted out from upper support joist 60). The positioning of the flooring elements will prevent further rotation of spacer 100 about a vertical axis in either the first direction or an opposite, second direction.

It is preferable (although not essential) for retention portion 103 to abut a wall of upper portion of recess 65 when spacer 100 has been rotated (starting from an insertion position) in a first direction to be in the retained position and that the spacer arms are correctly aligned with the longitudinal axis of a support joist, as will be understood from FIG. 3*b*. Abutment provides an indication, when installing spacer 100 between flooring elements, that arms 102 of spacer 100 are correctly aligned with the flooring elements being fitted.

Figure 4A:
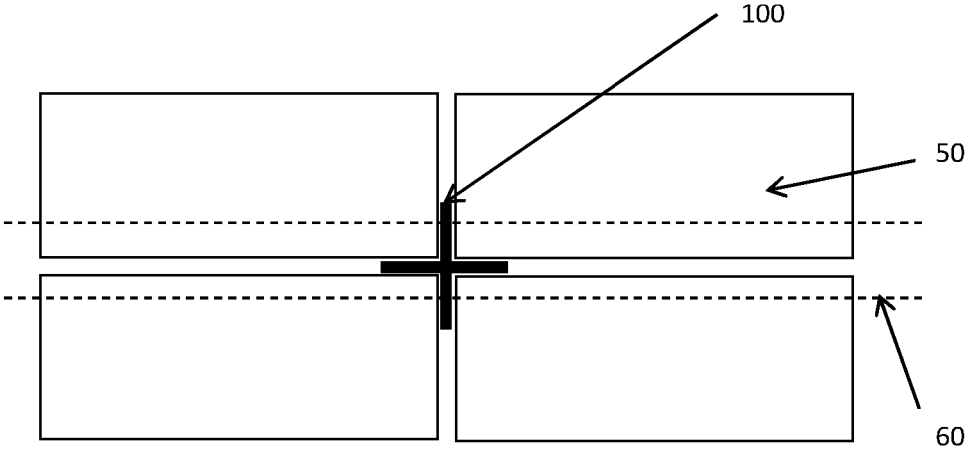
FIG. 4*a* is a schematic pan view of tiles separated by a spacer according to an embodiment of the invention.
Figure 4B:
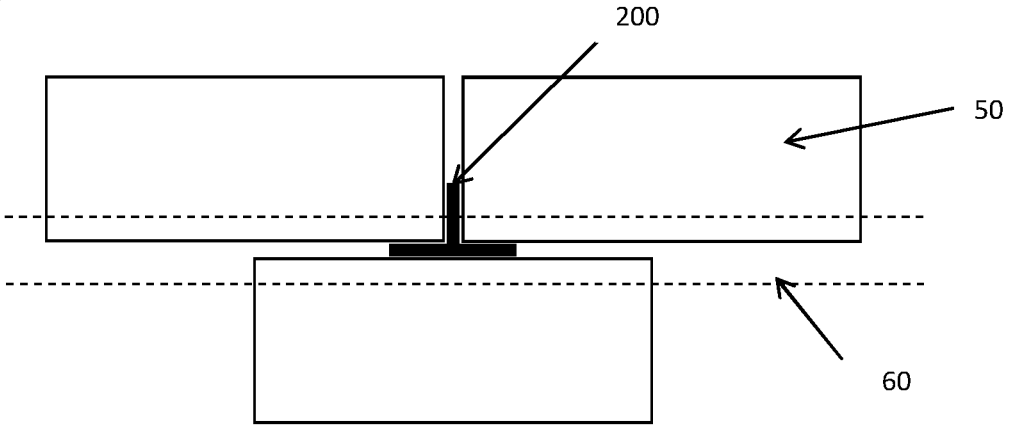
FIG. 4*b* is a further schematic pan view of tiles separated by a spacer according to an embodiment of the invention.
Figure 4C:
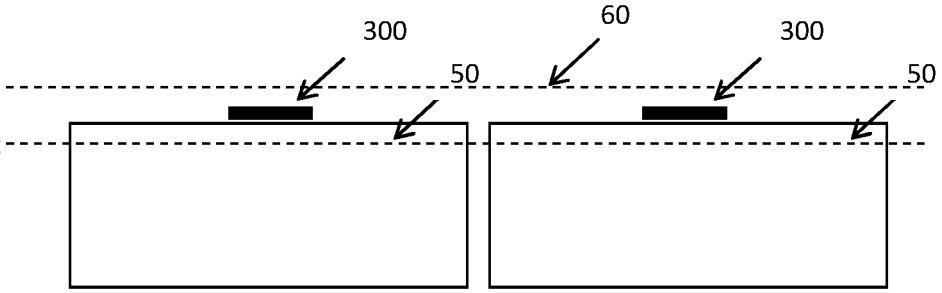
FIG. 4*c* is a schematic pan view of a spacer according to an embodiment of the invention.

FIGS. 4*a*, 4*b* and 4*c* are schematic plan views of a spacers (showing spacer arms only) for different configurations of flooring elements. FIG. 4*a* shows spacer 100, as described above, positioned between corners of different flooring elements 50. Spacer 200, as shown in FIG. 4*b*, has three spacer arms such that the spacer arms are T-shaped in cross section to separate two corners and a side of different flooring elements. Spacer 300, as shown in FIG. 4*c*, has two spacer arms parallel to each other and in-line such that the spacer arms are straight to abut flooring element 50 adjacent the perimeter of the deck.

It will be appreciated that the rotational symmetry of spacers 100, 200 and 300 allows for the spacers to be used for spacing between all possible configurations of flooring elements 50 (having 90 degree corners) by rotating spacers 200 and 300 through 180 degrees about a vertical axis before insertion, in addition to a 45 degree rotation (after insertion) described above (i.e. spacers 200 and 300 are rotated by +45 degrees, −45 degrees, +180+45 degrees and +180−45 degrees to separate flooring elements various configurations).

Figure 5A:
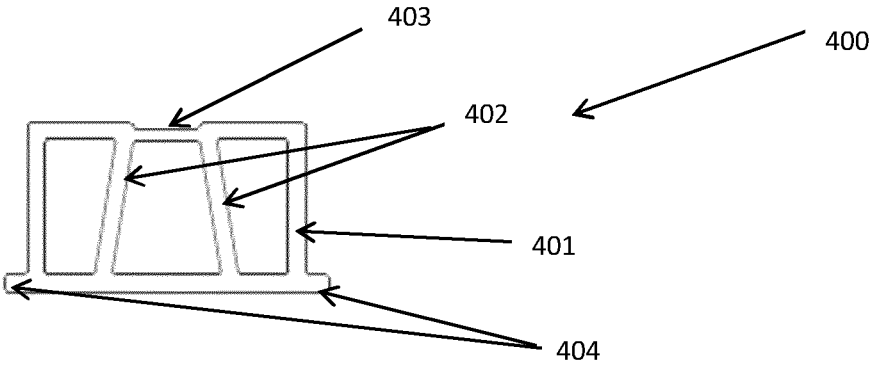
FIG. 5*a* is a cross section of a lower support joist for a support system according to an embodiment of the invention.
Figure 5B:
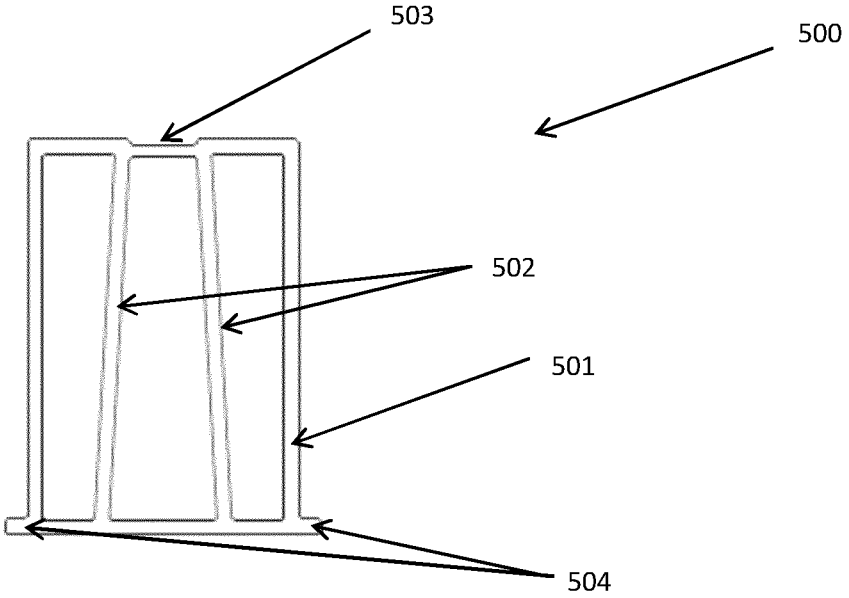
FIG. 5*b* is a cross section of a further lower support joist for a support system according to an embodiment of the invention.

FIGS. 5*a* and 5*b* are cross sections of lower support joists 400, 500. Lower support joist 400 of FIG. 5*a* is shorter in height than lower support joist 500 of FIG. 5*b*. The choice between different lower support joists is largely dependent upon the material of the flooring elements that are to be laid on top of the substructure of the joist lattice (as is described further below). Support joists are formed from aluminium alloy, timber, composite or steel, among other possible materials. Lower support joists 400 and 500 have three distinct hollow sections formed from exterior profile 401, 501 and interior walls 402, 502. Interior walls 402, 502 are offset from the vertical for lateral strength. The upper surface of exterior profile 401, 501 comprises depression 403, 503 which extends along the longitudinal length of lower support joists 400, 500.

Figure 5C:
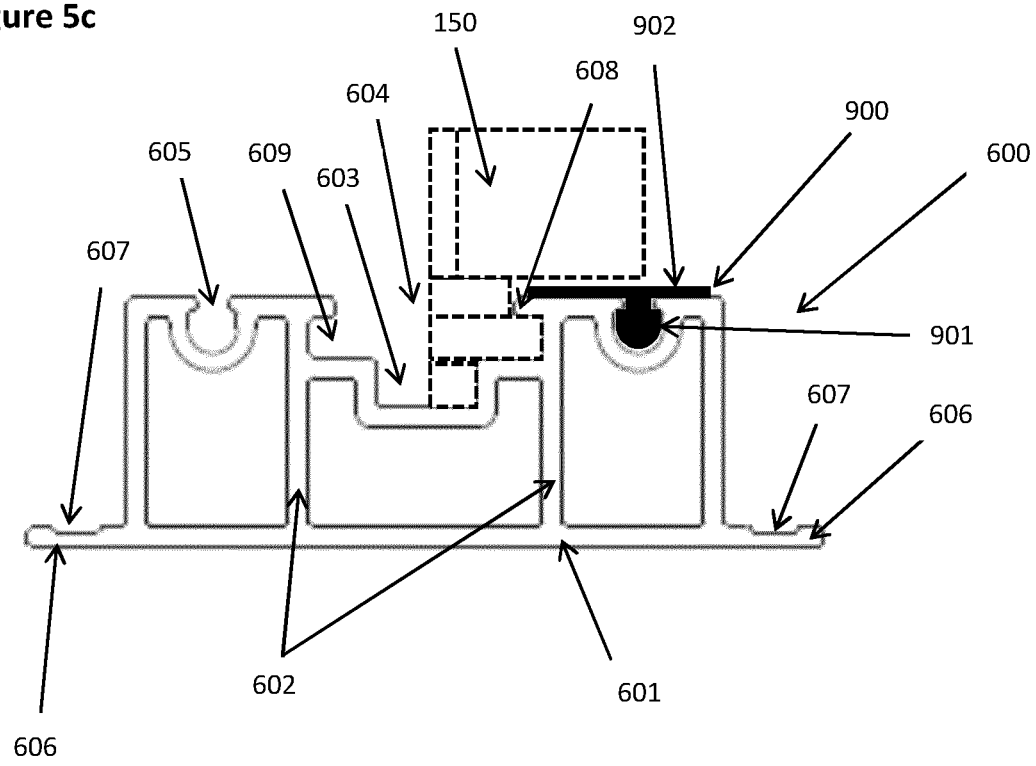
FIG. 5*c* is a cross section of an upper support joist for a support system according to an embodiment of the invention

FIG. 5*c* is a cross section of an upper support joist 600. Part of the spacer 150 is shown to demonstrate how the spacer 150 engages with the joist 600. It will be appreciated that only half of the spacer is shown for clarity. Further, a seal 900 is shown on the right hand side of the joist 600 (whereas in reality, two such seals would be provided as will become apparent below). Upper support joist 600 has three hollow sections formed from exterior profile 601 and vertical interior walls 602. Recess 604 extends along the length of upper support joist 600 on its upper side and has a lower recess portion 603 (which receives the protrusion of the spacer 150, as described above) and an upper recess portion 609 (which receives the retention portion of the spacer 150). Overhang 608 prevents vertical movement of the spacer 150, as described above. A flange 606 extends laterally from a bottom surface of upper support joist 600 on either side of upper support joist 600. Flange 606 has a depression 607, which extends along the length of flange 606 along the longitudinal axis of the upper support joist 600. The joist 600 further defines a pair of parallel, elongate seal receiving recesses 605, either side of the recess 604. The seal receiving recesses 605 are configured to accept a retaining bead 901 of the seal 900, each seal 900 providing a planar portion 902 on which floor members such as paving slabs can be supported. The seal 900 provides resilient support for the floor members, and also provides a stable base through which downward loads can be supported.

It will be noted that the spacer 150 and joist 600 are configured such that the spacer arms sit above the upper surface of the joist, and indeed are offset (i.e. a gap is provided) from the seal flange. This allows the spacers to be rotated and moved along the channel without fouling on the seal.

Figure 6:
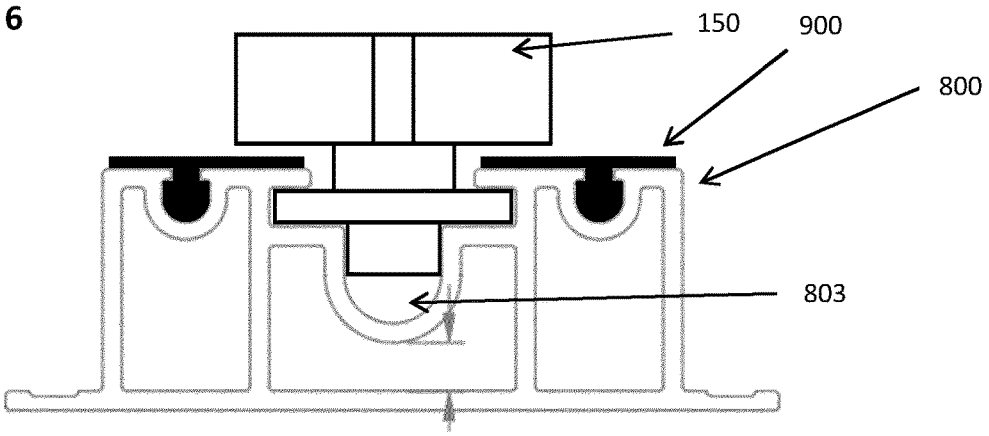
FIG. 6 is a cross section of an upper support joist for a support system according to an embodiment of the invention and a spacer positioned within a recess of the support joist.

FIG. 6 is a cross section of an upper supper joist 800 which has a concave, curved bottom surface of lower recess portion 803. As with FIG. 5*c*, the spacer 150 (this time in its entirety) and two seals 900 are shown in situ. This provides a gap between the protrusion of spacer 150 and the bottom surface of lower recess portion 803 which provides a conduit for fluid (e.g. rain water) to facilitate effective drainage along the length of the joist 800. Although lower recess portion 803 is shown as U-shaped in cross section in FIG. 6, lower recess portion 803 may be any shape in cross section, such as V-shaped or corrugated, that provides a gap for fluid flow.

Figure 7:
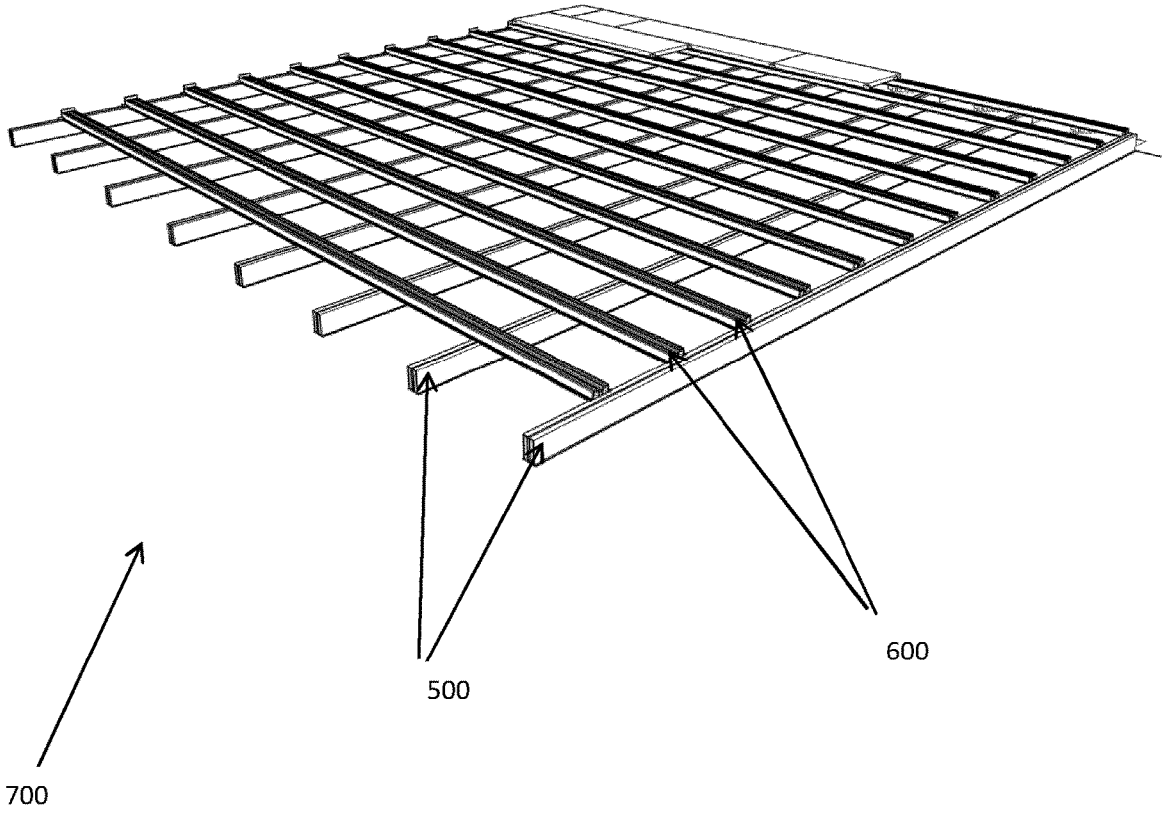
FIG. 7 is a schematic perspective view of a support substructure according to an embodiment of the invention.

FIG. 7 shows how multiple lower support joists 500 are laid parallel to each other and multiple upper support joists 600 are laid parallel to each other and perpendicular to the lower support joists 500. Where the upper and lower joists cross, the upper surface of exterior profile 501 of the lower joists 500 contacts flange 606 either side of the upper support joists 600. At each point of contact, a self-tapping screw is screwed into depression 607 and through the exterior profile 501 (or 401) at depression 503 (or 403). Depression 607 provides a space for a screw head. The diameter and depth of depressions 403, 503 is such that volume defined by the depression and the bottom surface of flange 606 of upper support joint 600 when screwed together is sufficient to accommodate the swarf generated by the insertion of the self-tapping screw. Tension caused by the screw causes the exterior profile 501 at the point of depression 503 to deform and bend upwards towards upper support joists 700. The reverse biasing force (i.e the force to revert the top surface of exterior profile to its original shape having depression 503) creates tension in the screw which help maintain the position of the screw and discourages unscrewing.

The provision of a crossed-lattice structure provides an extremely stiff and stable base for the overlying decking panels.

A flange 404, 504 extends laterally from the bottom surface of lower support joists 400, 500 along the length of support joists 400, 500. Flange 404, 504 is configured to snap-fit into lugs extending from the upper surface of a pedestal (not shown) which are positioned on a ground surface. In an alternative embodiment, flange 404, 504 rests against brackets located on the top surface of a pedestal.

To secure flooring elements and ensure they maintain a fixed position, it is desirable to secure stop-ends (or caps) to upper support joists along the perimeter of a flooring support system area. Stop ends are securely fixing to the distal ends of each upper support joist. For the two support joists whose longitudinal length defines two edges of the flooring support system area, stop ends are screwed or otherwise securely fixed to the upper support joists at intervals along the length of the upper support joists by screwing through depression 607 of flange 606 on the far side of the two upper support joists.

The invention claimed is:

1. A spacer for support elements of a decking or paving support system, comprising:

a central region on a central vertical axis of the spacer;

at least two spacer arms extending radially outwardly from the central region;

a retention portion coupled to the central region, wherein the retention portion has a longest lateral axis extending laterally and wherein the longest lateral axis lies at an angle of 45 degrees to each of the at least two spacer arms; and a protrusion extending axially from the retention portion, wherein the protrusion has a width that is less than a shortest lateral axis of the retention portion, wherein upon insertion into a recess of a support joist of the paving or decking support system, the recess having an upper portion and a lower portion, the lower portion having width smaller than the upper portion, the retention portion is in the upper portion and the protrusion is in the lower portion.

2. The spacer of claim 1, wherein the length of the shortest lateral axis is configured to be less than a width of an opening of the longitudinal recess of the support joist.

3. The spacer of claim 2, wherein the longest lateral axis of the retention portion is configured to be longer that a width of an overhang of a longitudinal recess in the support joist.

4. The spacer of claim 3, wherein the retention portion is configured to be positioned in the longitudinal recess of the support joist and is rotatable relative to the support joist such that the longest axis of the retention portion, after rotation, extends beyond the overhang of the longitudinal recess of the support joist.

5. The spacer of claim 4, wherein the longest axis of the retention portion is configured such that the retention portion abuts a wall of the longitudinal recess of the support joist after rotation.

6. The spacer of claim 1, comprising four of the spacer arms separated by 90 degrees.

7. The spacer of claim 1, comprising three of the spacer arms, wherein first and second arms are separated by 180 degrees and first and third spacer arms are separated by 90 degrees.

8. The spacer of claim 1, comprising two of the spacer arms separated by 90 degrees.

9. The spacer of claim 1, wherein the retention portion is a parallelogram, rectangle, square, hexagon, octagon, oblong or oval.

10. The spacer of claim 1, wherein the protrusion is circular in lateral cross section.

11. The spacer of claim 1, wherein the retention portion is provided in the shape of a hexagon.

12. The spacer of claim 11, wherein the retention portion is provided in the shape of an elongated hexagon.

13. The spacer of claim 1, wherein the protrusion is part of the spacer such that the protrusion rotates within the lower portion during rotation of the spacer.

14. An exterior flooring support system, comprising:

at least one support joist having a longitudinal recess, wherein the longitudinal recess has an upper portion and a lower portion, the lower portion having a width smaller than the upper portion, wherein the longitudinal recess has an opening, and wherein the opening is defined by an overhang of the longitudinal recess, a spacer for spacing flooring elements, wherein the spacer comprises:

a central region on a central vertical axis of the spacer, at least two spacer arms extending radially outwardly from the central region, a retention portion coupled to the central region, wherein the retention portion has a longest lateral axis extending laterally at an angle of 45 degrees to the at least two spacer arms, and a protrusion extending axially from the retention portion, wherein the protrusion has a width that is less than a shortest lateral axis of the retention portion, wherein the spacer is insertable in the longitudinal recess of the support joist in an insertion position with the retention portion in the upper portion of the longitudinal recess and the protrusion in the lower portion of the longitudinal recess, wherein the spacer is rotatable in a first direction from the insertion position by an angle from 1 to of 45 degrees to a retaining position with the retention portion in the upper portion of the longitudinal recess and the protrusion in the lower portion of the longitudinal recess, wherein the retention portion extends beyond a width of the opening of the longitudinal recess in the retaining position to prevent removal of the spacer from the longitudinal recess;

wherein the retention portion is configured to abut a wall of the longitudinal recess of the support joist in the retaining position to prevent further rotation of the spacer in the first direction.

15. The system of claim 14, wherein the retention portion has a shortest lateral axis which is shorter than the width of the opening of the longitudinal recess of the exterior flooring support joist.

16. The system of claim 14, wherein the retention portion is provided in the shape of a hexagon.

17. The system of claim 16, wherein the retention portion is provided in the shape of an elongated hexagon.

18. The spacer of claim 14, wherein the protrusion is part of the spacer such that the protrusion rotates within the lower portion during rotation of the spacer.

19. A substructure for a paving or decking support system, comprising at least two upper support joists extending in a first direction, each of the at least two upper support joists comprise a longitudinal recess having an upper portion and a lower portion, the lower portion having a width smaller than the upper portion, wherein the longitudinal recess has an opening, and wherein the opening is defined by an overhang;

at least two lower joists extending in a second direction;

wherein the at least two lower joists are positioned below the at least two upper support joists; and a spacer comprising:

a central region on a central vertical axis of the spacer;

at least two spacer arms extending radially outwardly from the central region;

a retention portion coupled to the central region, wherein the retention portion has a longest lateral axis extending laterally and wherein the longest lateral axis lies at an angle of 45 degrees to each of the at least two spacer arms; and a protrusion extending axially from the retention portion, wherein the protrusion has a width that is less than a shortest lateral axis of the retention portion;

wherein the spacer is engaged with the longitudinal recess of the support joist in an insertion position with the retention portion in the upper portion of the longitudinal recess and the protrusion in the lower portion of the longitudinal recess, wherein the spacer is rotatable in a first direction from the insertion position by an angle from 1 to 45 degrees to a retaining position, wherein the retention portion extends beyond the width of the opening of the longitudinal recess in the retaining position with the retention portion in the upper portion of the longitudinal recess and the protrusion in the lower portion of the longitudinal recess to prevent removal of the spacer from the longitudinal recess.

20. The substructure of claim 19, wherein each of the at least two upper support joists comprise at least one flange extending laterally from a bottom surface of the upper support joists and along a length of the at least two upper support joists, wherein an upper surface of the at least one flange comprises a depression which extends along a length of the flange.

* * * * *